US006446026B1

(12) United States Patent
Dean et al.

(10) Patent No.: US 6,446,026 B1
(45) Date of Patent: Sep. 3, 2002

(54) METHOD AND SYSTEM FOR IDENTIFYING PERFORMANCE DEGRADATION OF A COOLING SUBSYSTEM IN A LOCOMOTIVE

(75) Inventors: Jason A. Dean, Erie; Myron L. Smith, Fairview; William Roy Schneider, Erie, all of PA (US)

(73) Assignee: General Electric Company

( * ) Notice: Subject to any disclaimer, the term of this patent is extended or adjusted under 35 U.S.C. 154(b) by 0 days.

(21) Appl. No.: 09/429,407

(22) Filed: Oct. 28, 1999

(51) Int. Cl.[7] ..... G06F 11/00

(52) U.S. Cl. ..... 702/182; 123/41.31; 123/41.49; 361/695

(58) Field of Search ..... 702/182, 183, 702/184, FOR 103, FOR 104, FOR 106, FOR 110, FOR 111; 123/41.49, 41.31, 41.11, 41.15, 41.12, 41.32, 491, 41–46; 361/695

(56) References Cited

U.S. PATENT DOCUMENTS

| | | | | | |
|---|---|---|---|---|---|
| 4,270,174 | A | | 5/1981 | Karlin et al. | |
| 4,274,381 | A | * | 6/1981 | Abo | 123/479 |
| 4,275,688 | A | * | 6/1981 | Abe et al. | 123/41.12 |
| 4,463,418 | A | | 7/1984 | O'Quin, II et al. | |
| 4,517,468 | A | | 5/1985 | Kemper et al. | |
| 4,695,946 | A | | 9/1987 | Andreasen et al. | |
| 4,823,914 | A | | 4/1989 | McKinney et al. | |
| 4,930,460 | A | * | 6/1990 | Aihara et al. | 123/41.49 |
| 4,970,725 | A | | 11/1990 | McEnroe et al. | |
| 4,977,390 | A | | 12/1990 | Saylor et al. | |
| 4,977,743 | A | * | 12/1990 | Aihara et al. | 60/605.3 |
| 4,977,862 | A | * | 12/1990 | Aihara et al. | 123/41.12 |
| 5,113,489 | A | | 5/1992 | Cihiwsky et al. | |
| 5,123,017 | A | | 6/1992 | Simpkins et al. | |
| 5,157,610 | A | | 10/1992 | Asano et al. | |
| 5,274,572 | A | | 12/1993 | O'Neill et al. | |
| 5,282,127 | A | | 1/1994 | Mii | |
| 5,321,837 | A | | 6/1994 | Daniel et al. | |
| 5,329,465 | A | | 7/1994 | Arcella et al. | |
| 5,400,018 | A | | 3/1995 | Scholl et al. | |
| 5,406,502 | A | | 4/1995 | Haramaty et al. | |
| 5,445,347 | A | | 8/1995 | Ng | |
| 5,508,941 | A | | 4/1996 | Leplingard et al. | |
| 5,528,516 | A | | 6/1996 | Yemini et al. | |
| 5,566,091 | A | | 10/1996 | Schricker et al. | |
| 5,594,663 | A | | 1/1997 | Messaros et al. | |
| 5,633,628 | A | | 5/1997 | Denny et al. | |
| 5,638,296 | A | | 6/1997 | Johnson et al. | |
| 5,661,668 | A | | 8/1997 | Yemini et al. | |
| 5,666,534 | A | | 9/1997 | Gilbert et al. | |
| 5,678,002 | A | | 10/1997 | Fawcett et al. | |
| 5,742,915 | A | | 4/1998 | Stafford | |
| 5,815,071 | A | | 9/1998 | Doyle | |
| 5,845,272 | A | | 12/1998 | Morjaria et al. | |
| 5,950,147 | A | | 9/1999 | Sarangapani et al. | |
| 6,175,934 | B1 | | 1/2001 | Hershey et al. | |
| 6,200,021 | B1 | * | 3/2001 | Mitsutani et al. | 374/1 |
| 6,216,066 | B1 | | 4/2001 | Goebel et al. | |

OTHER PUBLICATIONS

Data–Tronic Gas Turbine Information And Control System; General Electric Gas Turbine Reference Library; 8 pages.

* cited by examiner

*Primary Examiner*—Marc S. Hoff
*Assistant Examiner*—Mohamed Charioui
(74) *Attorney, Agent, or Firm*—Carl A. Rowold, Esq.; Enrique J. Mora, Esq.; Beusse Brownlee Bowdoin & Wolter PA

(57) ABSTRACT

A method and system for identifying or determining degradation in performance of an engine cooling subsystem having an electric motor for powering a fan in a locomotive is provided. The method allows for monitoring a signal indicative of an electrical imbalance in one or more phases in the fan motor of the cooling subsystem, and for adjusting the value of the monitored signal for deviations from an estimated nominal phase signal value due to predetermined external variables so as to generate an adjusted phase signal value. The method further allows for comparing the value of the adjusted phase signal value against the nominal phase signal value to determine the performance of the cooling subsystem.

26 Claims, 5 Drawing Sheets

METHOD AND SYSTEM FOR IDENTIFYING PERFORMANCE DEGRADATION OF A COOLING SUBSYSTEM IN A LOCOMOTIVE

BACKGROUND OF THE INVENTION

The present invention relates generally to a locomotive having a subsystem for cooling an engine therein, and, more particularly, to a system and method for predicting impending failures in the cooling subsystem.

As will be appreciated by those skilled in the art, a locomotive is a complex electromechanical system comprised of several complex subsystems. Each of these subsystems is built from components which over time fail The ability to systematically predict failures before they occur in the locomotive subsystems is desirable for several reasons. For example, in the case of the engine cooling subsystem, that ability is important for reducing the occurrence of primary failures which result in stoppage of cargo and passenger transportation. These failures can be very expensive in terms of lost revenue due to delayed cargo delivery, lost productivity of passengers, other trains delayed due to the failed one, and expensive on-site repair of the failed locomotive. Further, some of those primary failures could result in secondary failures that in turn damage other subsystems and/or components. It will be further appreciated that the ability to predict failures before they occur in the cooling subsystem would allow for conducting condition-based maintenance, that is, maintenance conveniently scheduled at the most appropriate time based on statistically and probabilistically meaningful information, as opposed to maintenance performed regardless of the actual condition of the subsystems, such as would be the case if the maintenance is routinely performed independently of whether the subsystem actually needs the maintenance or not.

Needless to say, a condition-based maintenance is believed to result in a more economically efficient operation and maintenance of the locomotive due to substantially large savings in cost. Further, such type of proactive and high-quality maintenance will create an immeasurable, but very real, good will generated due to increased customer satisfaction. For example, each customer is likely to experience improved transportation and maintenance operations that are even more efficiently and reliably conducted while keeping costs affordable since a condition-based maintenance of the locomotive will simultaneously result in lowering maintenance cost and improving locomotive reliability.

Previous attempts to overcome the above-mentioned issues have been generally limited to diagnostics after a problem has occurred, as opposed to prognostics, that is, predicting a failure prior to its occurrence. For example, previous attempts to diagnose problems occurring in a locomotive have been performed by experienced personnel who have in-depth individual training and experience in working with locomotives. Typically, these experienced individuals use available information that has been recorded in a log. Looking through the log, the experienced individuals use their accumulated experience and training in mapping incidents occurring in locomotive subsystems to problems that may be causing the incidents. If the incident-problem scenario is simple, then this approach works fairly well for diagnosing problems. However, if the incident-problem scenario is complex, then it is very difficult to diagnose and correct any failures associated with the incident and much less to prognosticate the problems before they occur.

Presently, some computer-based systems are being used to automatically diagnose problems in a locomotive in order to overcome some of the disadvantages associated with completely relying on experienced personnel. Once again, the emphasis on such computer-based systems is to diagnose problems upon their occurrence, as opposed to prognosticating the problems before they occur. Typically, such computer-based systems have utilized a mapping between the observed symptoms of the failures and the equipment problems using techniques such as a table look up, a symptom-problem matrix, and production rules. These techniques may work well for simplified systems having simple mappings between symptoms and problems. However, complex equipment and process diagnostics seldom have simple correspondences between the symptoms and the problems. Unfortunately, as suggested above, the usefulness of these techniques have been generally limited to diagnostics and thus even such computer-based systems have not been able to provide any effective solution to being able to predict failures before they occur.

In view of the above-mentioned considerations, there is a general need to be able to quickly and efficiently prognosticate any failures before such failures occur in the cooling subsystem of the locomotive, while minimizing the need for human interaction and optimizing the repair and maintenance needs of the subsystem so as to able to take corrective action before any actual failure occurs.

BRIEF SUMMARY OF THE INVENTION

Generally speaking, the present invention fulfills the foregoing needs by providing a method for determining degradation in performance of an engine cooling subsystem having an electric motor for powering a fan in a locomotive. The method allows for monitoring a signal indicative of an electrical imbalance in at least one phase in the fan motor of the cooling subsystem, and for adjusting the value of the monitored signal for deviations from an estimated nominal phase signal value due to predetermined external variables so as to generate an adjusted phase signal value. The method further allows for comparing the value of the adjusted phase signal value against the nominal phase signal value to determine the performance of the cooling subsystem.

The present invention further fulfills the foregoing needs by providing a system for determining degradation in cooling subsystem performance in a locomotive having an engine cooled by a fan powered by a motor. The system is made up of a signal monitor coupled to monitor a signal indicative of an electrical imbalance in at least one phase in the fan motor of the cooling subsystem. A first module is coupled to the signal monitor to adjust the monitored signal for deviations from an estimated nominal phase signal value due to predetermined external variables to generate an adjusted phase signal value, and a second module is coupled to the first module to receive the adjusted phase signal value. The second module is configured to compare the value of the adjusted phase signal value against a nominal phase signal value to determine the performance of the cooling subsystem.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
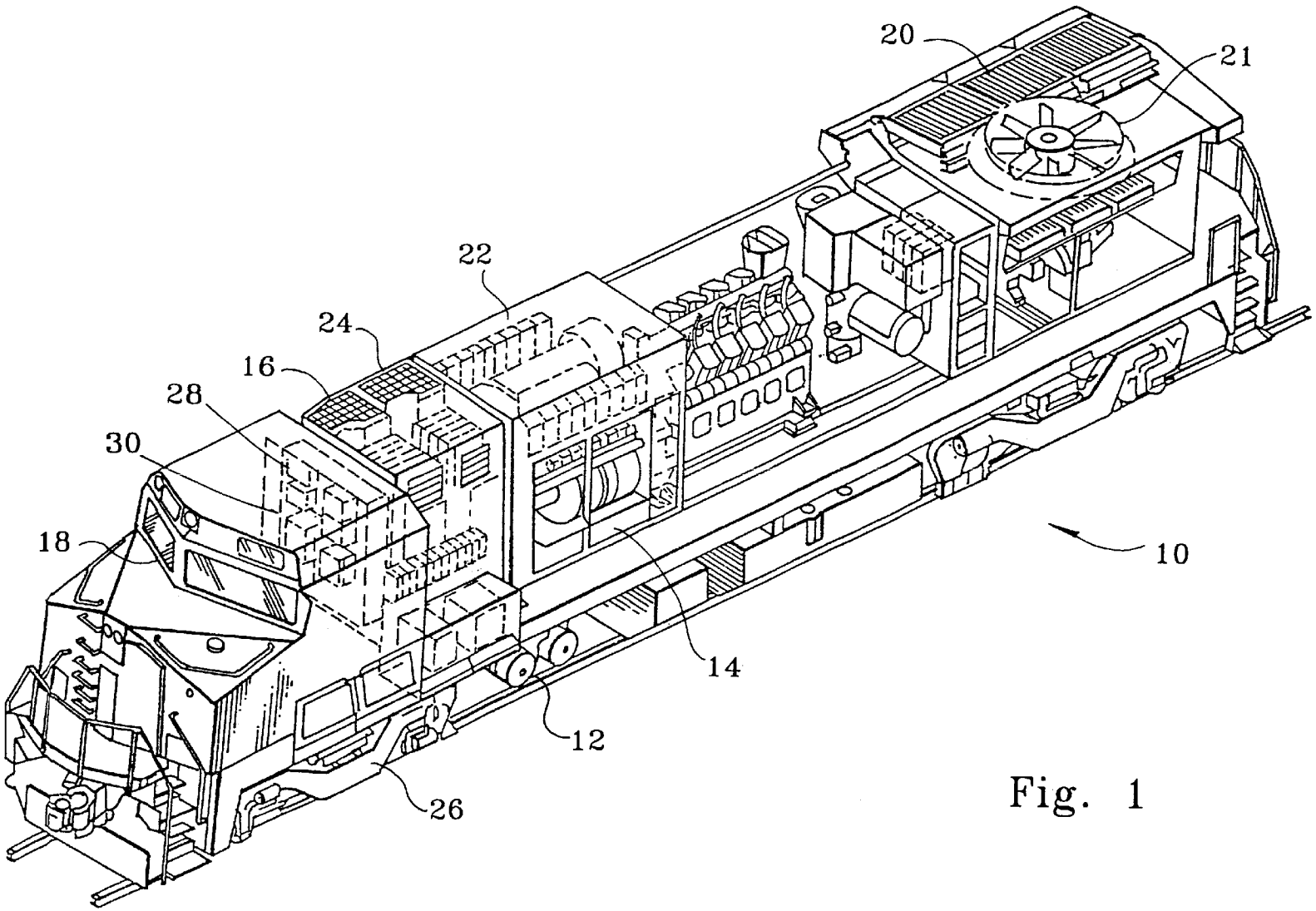
FIG. 1 shows an exemplary schematic of a locomotive.

FIG. 1 shows a schematic of a locomotive 10, that may be either an AC or DC locomotive. As will be appreciated by those skilled in the art, the locomotive 10 is comprised of several relatively complex subsystems, each performing separate functions. By way of background some of the subsystems and their functions are listed below.

An air and air brake subsystem 12 provides compressed air to the locomotive, which uses the compressed air to actuate the air brakes on the locomotive and cars behind it.

An auxiliary alternator subsystem 14 powers all auxiliary equipment. In particular, subsystem 14 supplies power directly to an auxiliary blower motor and an exhauster motor. Other equipment in the locomotive is powered through a cycle skipper.

A battery and cranker subsystem 16 provides voltage to maintain the battery at an optimum charge and supplies power for operation of a DC bus and a HVAC system.

A communications subsystem collects, distributes, and displays communication data across each locomotive operating in hauling operations that use multiple locomotives.

A cab signal subsystem 18 links the wayside to the train control system. In particular, the system 18 receives coded signals from the rails through track receivers located on the front and rear of the locomotive. The information received is used to inform the locomotive operator of the speed limit and operating mode.

A distributed power control subsystem provides remote control capability of multiple locomotive-consists anywhere in the train. It also provides for control of tractive power in motoring and braking, as well as air brake control.

As will be described in further detail in the context of FIG. 2, an engine cooling subsystem 20 provides the cooling means, such as an electrically powered radiator fan 21 and other components, by which the engine and other equipment reject heat to the cooling water. In addition, it minimizes engine thermal cycling by maintaining an optimal engine temperature throughout the load range and prevents engine overheating under various operating conditions, such as may be encountered when the locomotive travels in tunnels, etc. As suggested above, it is desired to develop a predictive diagnostic strategy that is suitable to predict incipient failures in the cooling subsystem.

An end of train subsystem provides communication between the locomotive cab and the last car via a radio link for the purpose of emergency braking.

An equipment ventilation subsystem 22 provides the means to cool the locomotive equipment.

An event recorder subsystem records FRA required data and limited defined data for operator evaluation and accident investigation. For example, such recorder may store about 72 hours or more of data.

For example, in the case of a locomotive that uses one or more internal combustion engines, such as diesel engines, a fuel monitoring subsystem provides means for monitoring the fuel level and relaying the information to the crew.

A global positioning subsystem uses NAVSTAR satellite signals to provide accurate position, velocity and altitude measurements to the control system. In addition, it also provides a precise UTC reference to the control system.

A mobile communications package subsystem provides the main data link between the locomotive and the wayside via a 900 MHz radio.

A propulsion subsystem 24 provides the means to move the locomotive. It also includes the traction motors and dynamic braking capability. In particular, the propulsion subsystem 24 receives electric power from the traction alternator and through the traction motors, converts that power to locomotive movement. The propulsion subsystem may include speed sensors that measure wheel speed that may be used in combination with other signals for controlling wheel slip or creep either during motoring or braking modes of operation using control technique well-understood by those skilled in the art.

A shared resources subsystem includes the I/O communication devices, which are shared by multiple subsystems.

A traction alternator subsystem 26 converts mechanical power to electrical power which is then provided to the propulsion system.

A vehicle control subsystem reads operator inputs and determines the locomotive operating modes.

The above-mentioned subsystems are monitored by one or more locomotive controllers, such as a locomotive control system 28 located in the locomotive. The locomotive control system 28 keeps track of any incidents occurring in the subsystems with an incident log. An on-board diagnostics subsystem 30 receives the incident information supplied from the control system and maps some of the recorded incidents to indicators. The indicators are representative of observable symptoms detected in the subsystems. Further background information regarding an exemplary diagnostic subsystem may be found in U.S. Pat. No. 5,845,272, assigned to the same assignee of the present invention and herein incorporated by reference.

Figure 2:
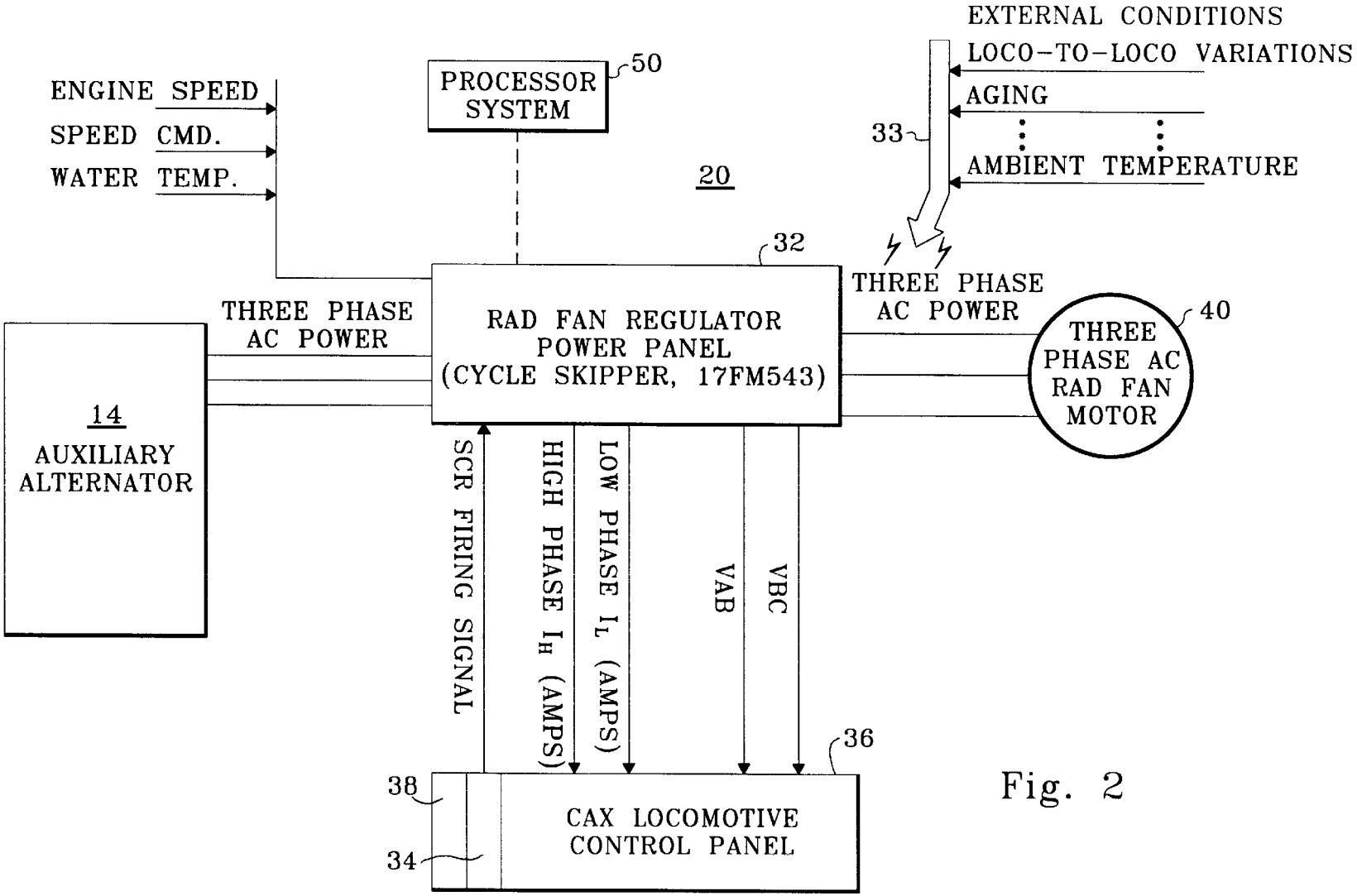
FIG. 2 shows an exemplary engine cooling subsystem.

FIG. 2 shows further details regarding an exemplary cooling subsystem 20 that can readily benefit from the teachings of the present invention. As shown in FIG. 2, auxiliary alternator 14 supplies three phase AC power to a suitable radiator (rad) fan regulator power panel 32 that includes a plurality of power switching gates, such as 16 or more semiconductor controlled rectifiers, SCRs (not shown), that respond to a respective firing signal supplied from a firing module 34 in a locomotive control panel 36. The timing for each firing signal may be controlled by a regulating module 38 in control panel 36 using techniques wellunderstood in the art of SCR control. Power panel 32 is electrically coupled to supply electrical power to a three-phase electric motor 40 that in turn is mechanically coupled to radiator fan 21 so as to blow cooling air through the fins of the radiator through which engine coolant fluid flows for thermal cooling. In one exemplary implementation, regulator panel 32 is coupled to receive a signal indicative of engine speed, such as engine revolutions per minute or engine RPM that may be conveniently supplied from an electromagnetic sensor at the engine. Regulator panel 32 is further coupled to receive a fan command speed signal that indicates a desired fan speed and a signal indicative of engine coolant temperature. The foregoing signals that are received by regulator panel 32 provide information to the regulator that allows for generating a suitable frequency in the power signals supplied to the radiator fan motor so as to rotate and maintain the fan speed at a selected rotation speed, such as full engine RPM, or ½ of engine RPM or ¼ of engine RPM. It will be appreciated that the performance of cooling subsystem 20 may be affected due to various conditions collectively represented by main arrow 33, such as age of the various components of subsystem 20, or cooling subsystem variation from locomotive-to-locomotive, engine load, fan speed, environmental conditions, etc.

As will be described in further detail below, respective voltage and current signals, that are developed in the respective fan motor phases allow for determining the performance of cooling subsystem 32. As shown in FIG. 2, for example, the letters IH and IL respectively designate the highest and lowest phase currents respectively developed in any two phases of the fan motor. Also, the letters VAB designate the voltage signal developed across phases A and B of the motor. Similarly, the letters VBC designate the voltage signal developed across phases B and C of the motor.

As will be appreciated by those skilled in the art, under both standard load and standard fan speed, and while in steady state operation, the vectorial or phasor sum of the three-phase current signals would result in a net signal combination substantially equal to zero. However, if one or more components of the cooling subsystem, gradually begins to deviate from its nominal performance, then the vectorial combination of the three-phase signals would no longer be equal to zero due to imbalances in one or more of the respective phase signals. Although the signal imbalance could be detected by measuring the respective values of each phase current, as suggested above, measuring the respective highest and lowest phase current signal conveniently allows for detection of signal imbalances in at least one of the three motor phases. It will be further appreciated that such signal imbalances may also result when the locomotive operates under strenuous environmental conditions or loads. Thus, in one key feature of the present invention, it is advantageous to compensate for signal imbalances that may be induced due to such strenuous operating conditions or loads so as to be able to accurately distinguish between a true degradation in performance, as opposed to an apparent degradation due to external variables or conditions, such as the value of the commanded fan speed signal or the value of the engine RPM, or age of the subsystem, or expected variation in the subsystem from locomotive-to- locomotive. A processor system 50 may be coupled to regulator panel 32 to monitor and collect the various signals that would allow the processor to assess the performance of the cooling subsystem 20. It will be appreciated that processor system 50 may be installed on-board or could be installed at a remote diagnostics site that would allow a service provider to monitor a fleet of locomotives. By way of example, signal transmission from the locomotive to the diagnostics site could be implemented using a suitable wireless data communication system and the like.

Figure 3:
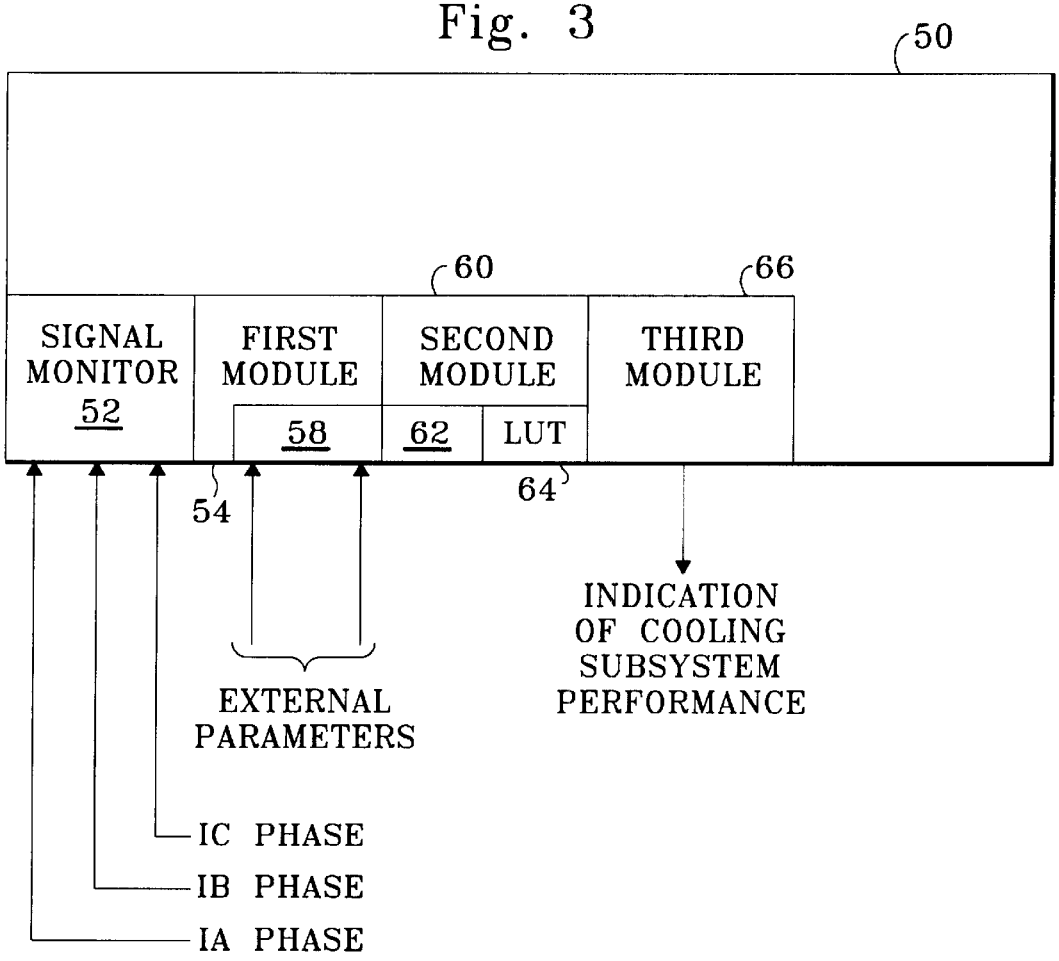
FIG. 3 shows a block diagram representation of a processor system that can be used for predicting impending failures in the subsystem of FIG. 2.

FIG. 3 shows further details regarding processor system 50 that includes a signal monitor 52 that receives the respective fan motor phase current signals to monitor signal imbalances, such as phasor imbalances in at least one of the three phase signals. An exemplary transfer function that may be useful to asses the performance of the cooling subsystem could be as follows:

$$\text{RFP_Phase_diff}=(\text{RFP_HI_current}-\text{RFP_low_current})+K_{spdcmd}*K_{engrpm}\ldots*K_n, \quad \text{Eq. (1).}$$

wherein RFP_HI_current denotes the respective phase current signal having the highest value, RFP_low_current denotes the respective phase current signal having the lowest value and $K_{spdcmd}*K_{engrpm}\ldots*K_n$ represents the product of n adjusting factors, such as adjusting factors for fan speed command, engine RPM, etc. It will be appreciated that the foregoing transfer function is merely illustrative being that other transfer functions could be readily realized using compensation techniques well-understood by those skilled in the art. In one exemplary implementation, the fan speed command may directly correspond to a selected engine speed command so that, if, for example, the engine is commanded to operate at full engine speed, then fan speed is also commanded to operate at maximum fan speed.

As further shown in FIG. 3, a first module 54 is coupled to signal monitor 52 to adjust the monitored signal or signals for deviations from an estimated nominal phase current value due to predetermined external variables to generate an adjusted phase current value. As shown in Eq. 1 above, the adjusted phase current value may be the signal represented by RFP_Phase_diff, and the adjusting factors may be represented by variables such as $K_{spdcmd}$, $K_{engrpm\ up\ to}$ $K_n$, since it will be appreciated that other correcting or adjusting factors could be included in Eq. 1 to adjust for other parameters or variables, such as aging of the subsystem, subsystem variation from locomotive-to-locomotive, etc. The adjusting factors may be empirically or experimentally derived by collecting actual data and/or simulation data that takes into account multiple scenarios of locomotive operation, and should preferably include a sufficiently large sample of locomotives and/or cooling subsystems so as to statistically demonstrate the validity and accuracy of the correcting factors.

A submodule 58 in first module 54 allows for retrieving and/or generating the respective adjusting factors. A second module 60 is electrically coupled to first module 54 to receive the adjusted phase current value. Second module 60 includes a respective submodule 62 that allows for comparing the value of the adjusted phase current value against the nominal phase current value to determine the performance of the cooling subsystem. As suggested above, the net result of Eq. 1, during steady state operation and during normal operation should be generally zero. A memory unit 64 may be used for storing a programmable look-up table (LUT) for storing a first range of phase current values so that adjusted phase current values within that first range are indicative of acceptable cooling subsystem performance. The look-up table in memory unit 4 may further be used for storing a second range of phase current values so that adjusted values within the second range are indicative of degraded cooling subsystem performance.

A third module 66 may be readily used for generating and issuing a signal indicative of a degraded cooling subsystem performance when the adjusted phase current value is beyond the first range of phase current values and within the second range of phase current values, that is, a cautionary signal that could be analogized to a yellow light in a traffic light. Similarly, module 66 may be used for generating and issuing a signal indicative of unacceptable cooling subsystem performance when the adjusted phase current value is beyond an upper limit of the second range of phase current values, that is, a warning signal that could be analogized to a red light in a traffic light that requires immediate action by the operator. An exemplary first range of values may be phase current values ranging from about zero Amps to about four Amps. An exemplary second range may range from about four Amps to about seven Amps. Thus, for the above ranges, if the result of Eq. 1, exceed seven Amps, then third module 66 will issue the red warning signal. Similarly, if the result of Eq. 1, is within the second range of values, then module 66 will issue the yellow cautionary signal. Finally, if the result of Eq. 1, is within the first range of values, then module 66 will simply indicate that the status of the cooling subsystem is within acceptable levels of performance.

Figure 4:
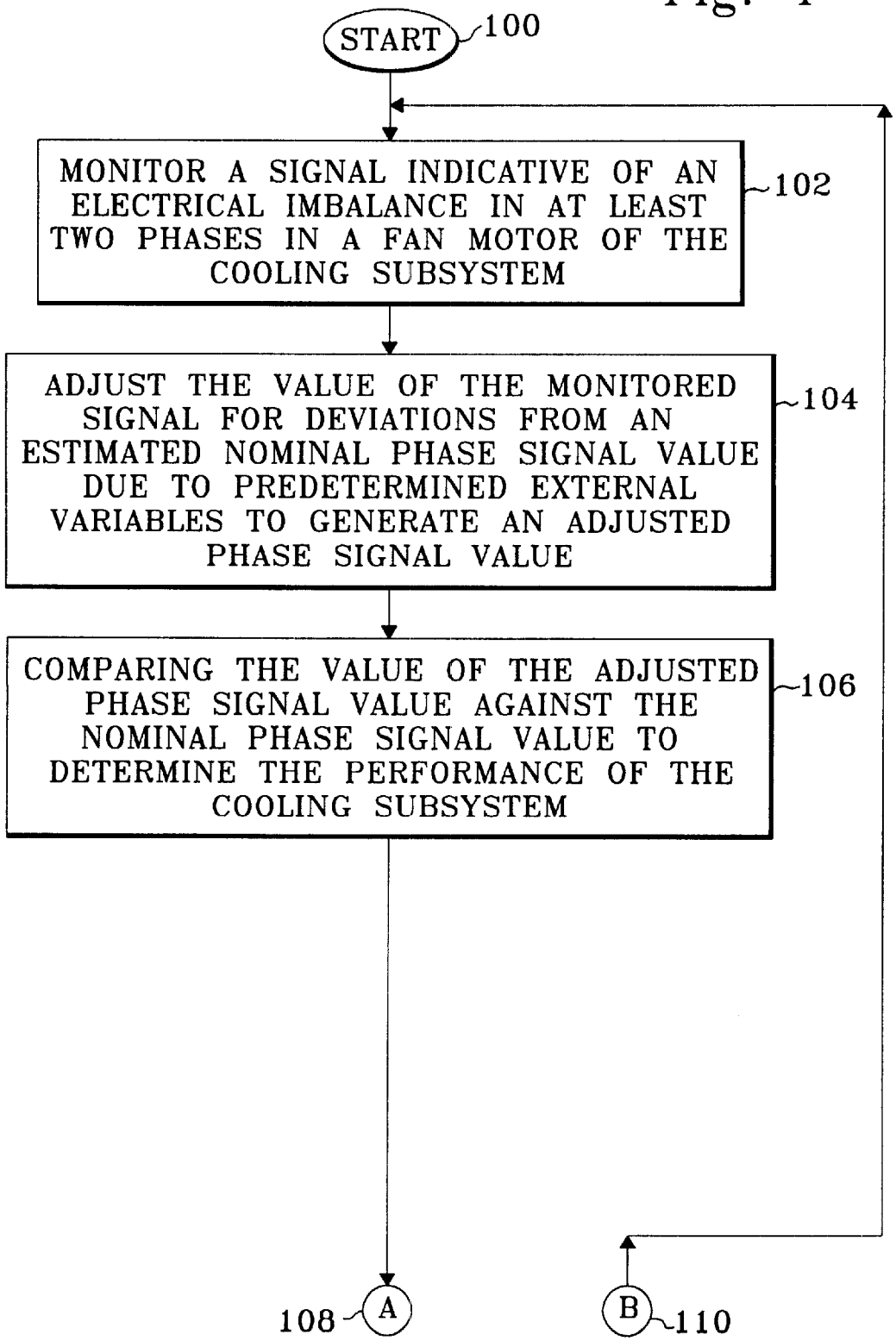
FIG. 4 is an exemplary flow chart of a method for predicting impending failures in the subsystem of FIG. 3.
Figure 5:
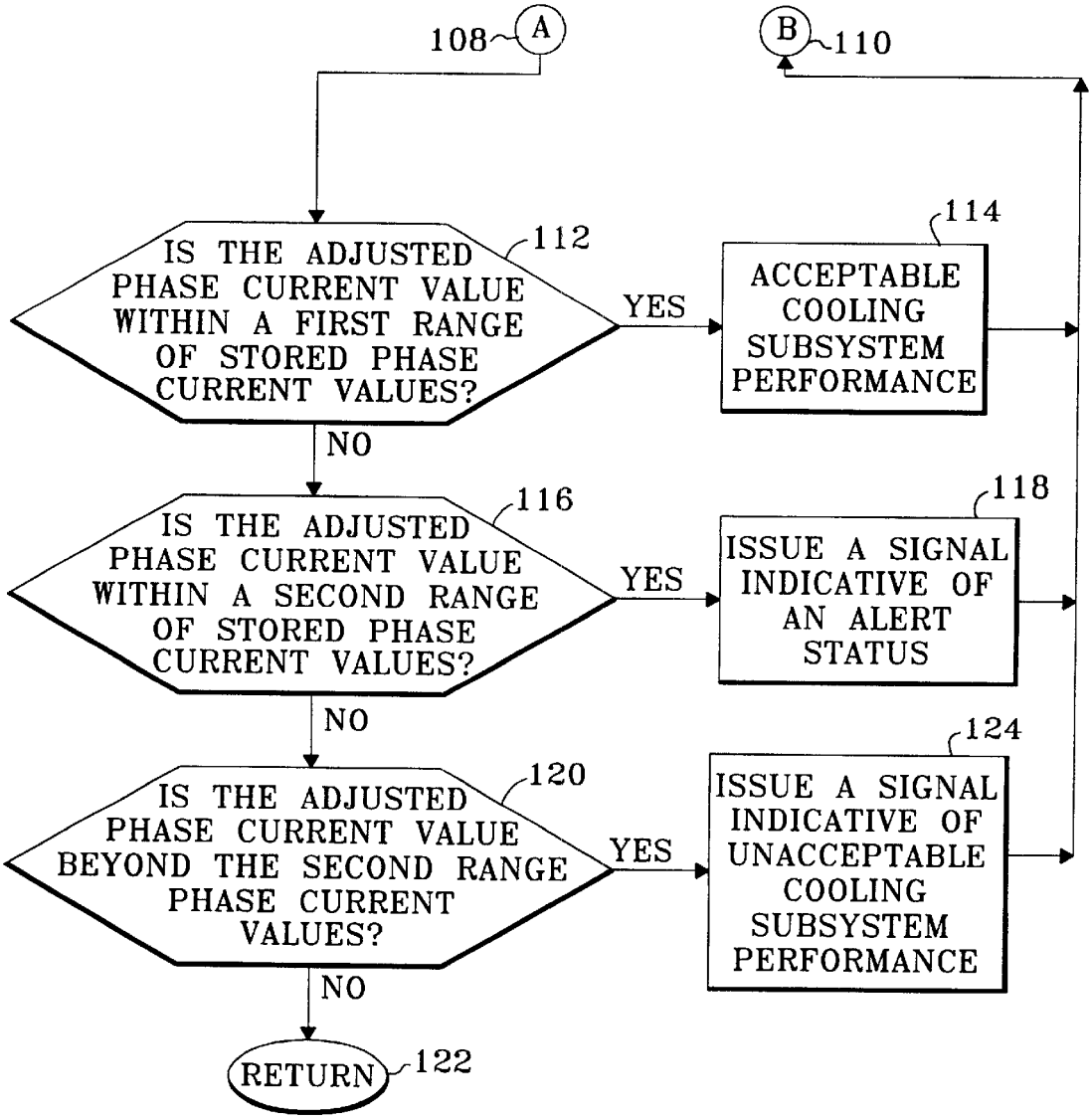
FIG. 5 illustrates further steps to the flow chart of FIG. 4 that allow for monitoring the performance of the cooling subsystem.

FIG. 4 is an exemplary flow chart of the method of the present invention for determining degradation in performance of the cooling subsystem of the locomotive. Upon start of operations in step 100, step 102 allows for monitoring a signal indicative of an electrical imbalance in at least one phase in the fan motor of the cooling subsystem. Step 104 allows for adjusting the value of the monitored signal for deviations from an estimated nominal phase signal value due to predetermined external variables to generate an adjusted phase signal value. In a preferred embodiment, the electrical imbalance is readily obtained by computing the difference of the phase current signal having the highest value and the phase current signal with the lowest value. Step 106 allows for comparing the value of the adjusted phase signal against the nominal phase signal value to determine the performance of he cooling subsystem.

Through connecting node A, step 112 allows for determining whether the adjusted phase current value is within the first range of phase current values stored in the LUT. If the answer is yes, then step 114 allows for declaring that the cooling subsystem has acceptable performance and the method is ready to start another iteration through connecting node B. If the answer is no, in step 112, then step 116 allows for determining whether the adjusted phase current value is within a second range of phase current values stored in the LUT. If the answer is yes, then step 118 allows for declaring that the system has degraded. If the answer is no, then step 120, prior to return step 122, allows for determining whether the adjusted phase current value exceeds the upper limit of the second range of phase current values stored in the LUT. If the answer is yes, then step 124 allows for declaring or indicating an unacceptable cooling subsystem performance. This indication will generally require suitable corrective action by the user.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A method for identifying degradation in performance of an engine cooling subsystem in a locomotive, the subsystem having an electric motor for powering a fan, the method comprising:

monitoring a signal indicative of an electrical imbalance in at least one phase in the fan motor of the cooling subsystem;

adjusting the value of the monitored signal for deviations from an estimated nominal phase signal value due to predetermined external variables so as to generate an adjusted phase signal value; and comparing the value of the adjusted phase signal value against the nominal phase signal value to determine the performance of the cooling subsystem.

2. The method of claim 1 wherein the electrical imbalance comprises a current imbalance in at least one phase in the fan motor.

3. The method of claim 2 wherein the adjusting step comprises adjusting the monitored signal for deviations from an estimated nominal phase current value due to the predetermined external variables to generate an adjusted phase current value.

4. The method of claim 3 wherein the comparing step comprises comparing the value of the adjusted phase current value against the nominal phase current value to determine the performance of the cooling subsystem.

5. The method of claim 4 further comprising a step of storing a first range of phase current values, and wherein adjusted phase current values within that first range are indicative of acceptable cooling subsystem performance.

6. The method of claim 5 further comprising a step of storing a second range of phase current values, and wherein adjusted phase current values within that second range are indicative of degraded cooling subsystem performance.

7. The method of claim 6 further comprising a step of issuing a signal indicative of an alert status for the cooling subsystem when the adjusted phase current value is within the second range of phase current values.

8. The method of claim 6 further comprising a step of issuing a signal indicative of unacceptable cooling subsystem performance when the adjusted phase current value is beyond an upper limit of the second range of phase current values.

9. The method of claim 2 wherein the monitored signal indicative of phase current imbalance is a difference of any two phase currents respectively having the highest and the lowest phase current values.

10. The method of claim 1 wherein the monitoring step further comprises monitoring the predetermined external variables.

11. The method of claim 10 wherein the predetermined external variables are selected from the group consisting of a speed command signal, a signal indicative of engine RPM, cooling subsystem age, and cooling subsystem variation from locomotive to locomotive.

12. The method of claim 1 wherein the adjusting step comprises generating a respective adjusting factor for each respective one of the external variables.

13. The method of claim 1 wherein the motor fan comprises a three-phase motor.

14. A system for determining degradation in cooling subsystem performance in a locomotive having an engine cooled by a fan powered by a motor, the system comprising:

a signal monitor coupled to monitor a signal indicative of an electrical imbalance in at least one phase in the fan motor of the cooling subsystem;

a first module coupled to the signal monitor to adjust the monitored signal for deviations from an estimated nominal phase signal value due to predetermined external variables to generate an adjusted phase signal value; and a second module coupled to the first module to receive the adjusted phase signal value, the second module configured to compare the value of the adjusted phase signal value against a nominal phase signal value to determine the performance of the cooling subsystem.

15. The system of claim 14 wherein the electrical imbalance comprises a current imbalance in at least one phase in the fan motor.

16. The system of claim 15 wherein the first module is configured to adjust the monitored signal for deviations from an estimated nominal phase current value due to the predetermined external variables to generate an adjusted phase current value.

17. The system of claim 16 wherein the second module has a submodule configured to compare the value of the adjusted phase current value against the nominal phase current value to determine the performance of the cooling subsystem.

18. The system of claim 17 further comprising a memory unit for storing a first range of phase current values so that adjusted phase current values within that first range are indicative of acceptable cooling subsystem performance.

19. The system of claim 18 wherein the memory unit is configured to store a second range of phase current values so that adjusted phase current values within that second range are indicative of degraded cooling subsystem performance.

20. The system of claim 19 further comprising a third module for issuing a signal indicative of a cautionary alert when the adjusted phase current value is within the second range of phase current values.

21. The system of claim 20 wherein the third module is further configured for issuing a signal indicative of unacceptable cooling subsystem performance when the adjusted phase current value is beyond an upper limit of the second range of phase current values.

22. The system of claim 15 wherein the monitored signal indicative of phase current imbalance is a difference of any two phase currents respectively having the highest and the lowest phase current values.

23. The system of claim 14 wherein the first module is configured to monitor the predetermined external variables.

24. The system of claim 23 wherein the predetermined external variables are selected from the group consisting of a speed command signal, a signal indicative of engine RPM, cooling subsystem age, and cooling subsystem variation from locomotive to locomotive.

25. The system of claim 14 wherein the fan motor comprises a three-phase motor.

26. The system of claim 14 wherein the first module has a submodule configured to generate a respective adjusting factor for each respective one of the external variables.

* * * * *